US011202930B2

(12) United States Patent
Lovas

(10) Patent No.: US 11,202,930 B2
(45) Date of Patent: Dec. 21, 2021

(54) INSTALLED FIRE EXTINGUISHING EQUIPMENT WITH EXTINGUISHING-LAUNCHING PART-UNIT

(71) Applicant: Swiss Fire Protection Research & Development AG, Sarnen (CH)

(72) Inventor: Laszlo Lovas, God (HU)

(73) Assignee: Swiss Fire Protection Research & Development AG, Sarnen (CH)

( * ) Notice: Subject to any disclaimer, the term of this patent is extended or adjusted under 35 U.S.C. 154(b) by 182 days.

(21) Appl. No.: 16/734,161

(22) Filed: Jan. 3, 2020

(65) Prior Publication Data

US 2020/0139175 A1 May 7, 2020

Related U.S. Application Data

(63) Continuation of application No. PCT/IB2017/054064, filed on Jul. 6, 2017.

(51) Int. Cl.
*A62C 35/02* (2006.01)
*A62C 35/62* (2006.01)
(Continued)

(52) U.S. Cl.
CPC ..... *A62C 35/023* (2013.01); *A62C 3/065* (2013.01); *A62C 35/62* (2013.01); *A62C 35/68* (2013.01); *A62C 37/11* (2013.01); *A62C 99/0036* (2013.01)

(58) Field of Classification Search
CPC ..... A62C 3/06; A62C 3/065; A62C 35/02; A62C 35/023; A62C 35/62; A62C 35/68; A62C 37/11; A62C 99/0036
See application file for complete search history.

(56) References Cited

U.S. PATENT DOCUMENTS 6,006,842 A * 12/1999 Stilwell ..... A62C 37/11 169/60
8,109,341 B1 * 2/2012 Szocs ..... A62C 3/065 169/9
(Continued)

FOREIGN PATENT DOCUMENTS

EP 1075316 A1 2/2001
EP 1534394 A1 1/2005
(Continued)

OTHER PUBLICATIONS

International Search Report and Written Opinion issued by the International Searching Authority dated Nov. 7, 2017 for corresponding International Patent Application No. PCT/IB2017/054064.
(Continued)

*Primary Examiner* — Darren W Gorman
(74) *Attorney, Agent, or Firm* — Smith & Hopen, P.A.

(57) ABSTRACT

A fire extinguishing equipment including an extinguishing-launching part-unit and a pressure-resistant storage body with an internal space housing a fire extinguishing material. A transport pipe is connected to the internal space to transport the fire extinguishing material to a use location. An extinguishing part-unit is connected to the external end of the transport pipe and includes one or more event-detecting part-units, which are connected to the extinguishing-launching part-unit. The extinguishing-launching part-unit is supplemented with a separation fitting disposed within the transport pipe, separated from a transport regulation fitting also disposed within the transport pipe. A reference pressure supply part-unit is within the transport pipe between the separation fitting and the transport regulation fitting. Each of the transport regulation fitting and the separation fitting includes a clamping housing and a rupture disc fixed therein,
(Continued)

which rupture upon detection of a fire to dispense the fire extinguishing material.

10 Claims, 1 Drawing Sheet

(51) Int. Cl.

| | |
|---|---|
| ***A62C 37/11*** | (2006.01) |
| ***A62C 35/68*** | (2006.01) |
| ***A62C 3/06*** | (2006.01) |
| *A62C 99/00* | (2010.01) |

(56) References Cited

U.S. PATENT DOCUMENTS

| | | | | |
|---|---|---|---|---|
| 10,099,077 | B2 * | 10/2018 | Szocs | A62C 3/065 |
| 2004/0188103 | A1 | 9/2004 | Laib et al. | |
| 2012/0118591 | A1 * | 5/2012 | Yen | A62C 99/0036 169/47 |

FOREIGN PATENT DOCUMENTS

| | | | |
|---|---|---|---|
| HU | 225884 | B1 | 11/2007 |
| HU | P1400270 | A2 | 5/2014 |
| WO | 2015181575 | A1 | 12/2015 |

OTHER PUBLICATIONS

International Preliminary Report on Patentability issued by the International Bureau dated Jan. 7, 2020 for corresponding International Patent Application No. PCT/IB2017/054064.

Translation of Hungarian Patent No. 225884B1 (filing date: Apr. 17, 2002) with a publication date of Nov. 28, 2007.

* cited by examiner

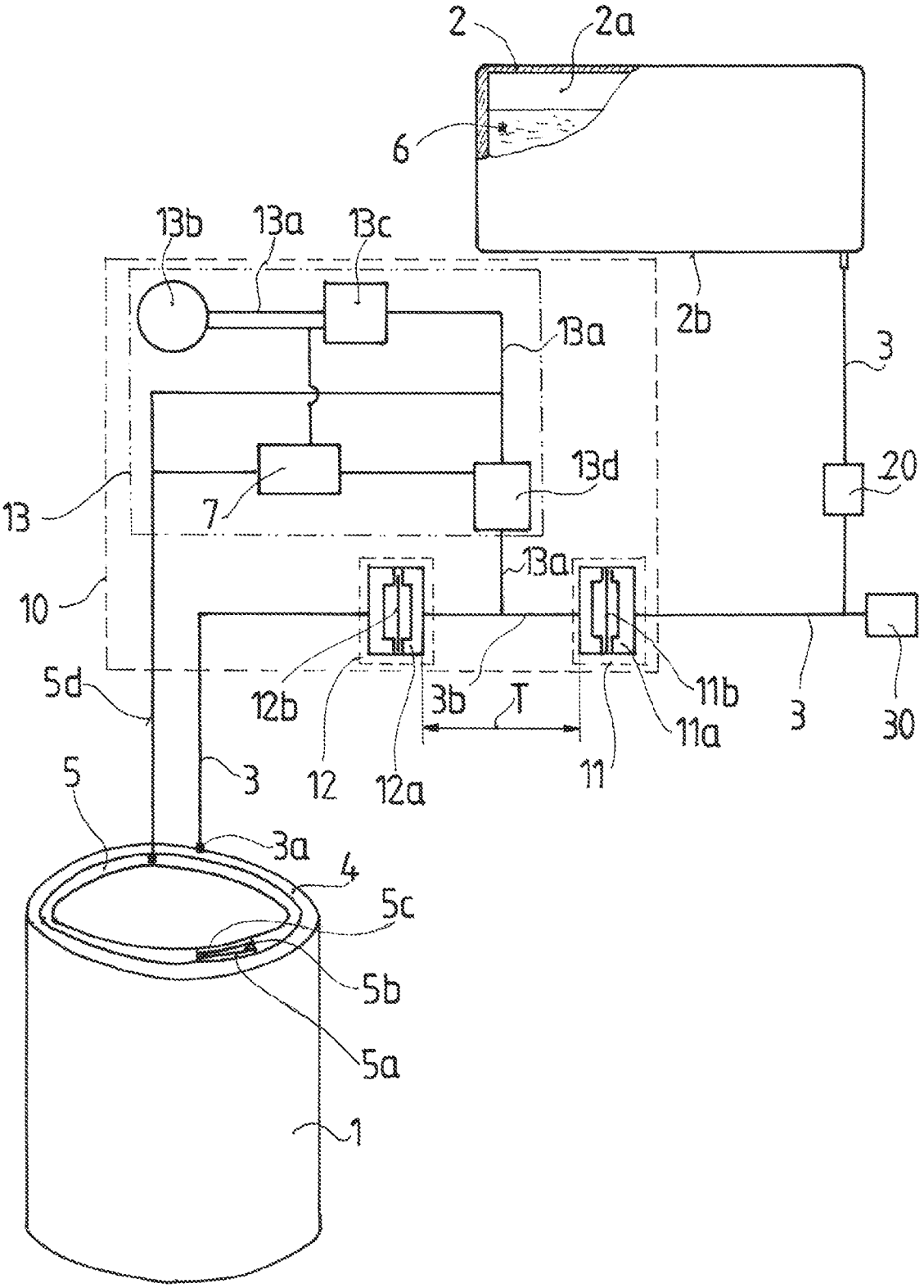
2
2a
6
13b
13a
13c
2b
3
13a
13d
20
13
7
13a
10
12b
3b
T
11b
11a
3
30
5d
12
12a
11
5
3
3a
4
5c
5b
5a
1

INSTALLED FIRE EXTINGUISHING EQUIPMENT WITH EXTINGUISHING-LAUNCHING PART-UNIT

CROSS-REFERENCE TO RELATED APPLICATIONS

This nonprovisional application is a continuation of and claims priority to international patent application No. PCT/USIB2017/054064, entitled "Installed fire extinguishing equipment with extinguishing-launching part-unit," filed Jul. 6, 2017 by the same inventor.

BACKGROUND OF THE INVENTION

The subject of the invention relates to installed fire extinguishing equipment with an extinguishing-launching part-unit, which has a pressure-resistant storage body with an internal space serving for accommodating a fire extinguishing mated al. Furthermore, at least one transport pipe is connected to the internal space of the storage body that is suitable for transporting the fire extinguishing material from the internal space of the storage body to the use location, as well as an extinguishing part-unit connected to the external end of the transport pipe in the vicinity of the use location. The extinguishing part-unit is coupled with one or more event-detecting (or event-sensing) part-units, where at least one part of the event-sensing part-unit is connected directly to an extinguishing-launching part-unit or via the interposition of a control center. The extinguishing-launching part-unit has a transport regulation fitting installed in the transport pipe.

With the development of information technology and telecommunications, remotely-controlled solutions have become widespread in which industrial operations, commercial operations, or safety technology tasks may be performed in the case of the fulfilment of certain conditions that are controlled from large distances, or even automatically by a device.

Such structural arrangements realizing condition-dependent execution are used, among other uses, in the case of installed fire-extinguishing equipment, especially in the case of fire extinguishing systems suitable for protecting liquid hydrocarbon storage tanks that have automatic extinguishing launching. An example of this is also shown in the solution presented in patent specification registration number HU225884 and in document number HU1400270. The essence of this known extinguishing-launching arrangement is that an event-detecting device is installed in the vicinity of the facility to be protected. The event-detecting device sends a signal to an evaluation and intervention center, and on the basis of the received signal, this center remotely instructs the structural elements responsible for discharging the extinguishing material; as a result of the use of external energy, the structural elements change their status and open the pathway for the extinguishing material. These structural elements are generally pneumatically or electrically controlled valves that are generally active intervention valves.

The disadvantage of such active intervention valves, however, is that their operation generally demands moving parts, which may become faulty or jammed, which may make it difficult to effectively extinguish or prevent the spread of fire. A further disadvantage is that, in general, intervention valves containing such moving parts require some form of auxiliary energy, such as electricity or a pneumatic medium, in order to work properly. In several cases, attempts have been made to operate them with energy stored in the drive unit of the fitting, an example of which may be a pneumatic drive supplied with a spring return which opens when the pneumatic pressure is lost. However, the lack of auxiliary energy may cause serious operation and safety problems. In this way, extinguishing may be launched that is not justified, or, in a worse case, extinguishing is not launched at all. In addition, the extent of the force and torque required for the operation of the fittings that are continuously loaded by one-sided pressure increases over time as a result of loss of lubricant and the adhesion of the sealing surfaces. Due to this, after a longer period, the opening of fittings installed in this way demands significantly more energy as compared to the original conditions, due to which it may occur that the drive is unable to operate.

Another disadvantage of the solutions using the known active intervention valves is that they must be periodically tested, precisely in order to check and avoid inoperability. However, during these tests, a part of the valuable extinguishing material is discharged, which causes extra operation costs due to the necessity of replacing the used extinguishing material. The performance of the test itself also increases the operation and maintenance costs, which is also a disadvantage of the known systems.

The objective of the arrangement according to the invention was to overcome the disadvantages caused by the known active intervention valves and to create an extinguishing-launching part-unit that has a simple structure, its operation does not require auxiliary energy, does not require periodical testing, has a minimal probability of failure, and so significantly increases the operability and effectiveness of the extinguishing system.

The recognition that led to the arrangement according to the invention was that, differently to what is usually used, if uniquely dimensioned rupture discs are used as the intervention body, and using these rupture discs in a completely different way to that known for a closed space, the maintenance of a given pressure value is created in the pipe serving for discharging the extinguishing material. The question becomes whether the pipe loses the pressure set in it when an undesired event occurs. Or, on the contrary, does the pressure drastically increase, and at this time the appropriately dimensioned rupture discs burst, due to which the given extinguishing material pipe becomes freely discharged, and the extinguishing process may start automatically without the input of any auxiliary energy, and so the task may be solved.

BRIEF SUMMARY OF THE INVENTION

In accordance with the set objective, the installed fire extinguishing equipment with extinguishing-launching part-unit has a pressure-proof storage body with an internal space serving for accommodating a fire extinguishing material. Furthermore, at least one transport pipe is connected to the internal space of the storage body that is suitable for transporting the fire extinguishing material from the internal space of the storage body to the use location. In addition, an extinguishing part-unit is connected to the external end of the transport pipe in the vicinity of the use location, the extinguishing part-unit being coupled with one or more event-detecting part-units. At least some of the event-sensing part-units are connected directly to an extinguishing-launching part-unit or via the interposition of a control center. The extinguishing-launching part-unit has a transport regulation fitting installed in the transport pipe and is set up in such a way that the extinguishing-launching part-unit is supplemented with a separation fitting separated from the transport regulation fitting by a space and also installed in the transport pipe. A reference pressure supply part-unit is installed in the regulation section of the transport pipe between the separation fitting and the transport regulation fitting. Furthermore, the transport regulation fitting has a clamping housing and a transport regulation rupture disc fixed in the clamping housing, while the separation fitting has a clamping housing and a separation rupture disc fixed in the clamping housing.

A further feature of the installed fire extinguishing equipment according to the invention may be that the event-detecting part-unit is a pneumatic detector with a pressure-retaining membrane that bursts on the effect of heat. A detecting space encompassed by the membrane or the event-detecting part-unit is a pneumatic detector with a pressure-retaining membrane filled with a charge that expands and/or evaporates on the effect of heat.

In an embodiment of the installed fire extinguishing equipment, when the extinguishing-launching part-unit is in its basic state, the value of the pressure in the regulation section of the transport pipe is less than the pressure in the internal space of the storage body.

In yet another embodiment of the invention, the bursting pressure of the separation rupture disc of the separation fitting is lower than the bursting pressure of the transport regulation rupture disc of the transport regulation fitting, and with the extinguishing-launching part-unit in its basic state, the value of the pressure in the regulation section of the transport pipe is greater than the pressure in the internal space of the storage body.

In an embodiment of the installed fire extinguishing equipment, the reference pressure supply part-unit has a gas pipe connected to the regulation section of the transport pipe, a compressor connected to the end of the gas pipe opposite to the regulation section, a pressure regulation fitting installed in the gas pipe, and, optionally, a shut-off fitting. Optionally, the event-detecting part-unit has a supply pipe, and the supply pipe is connected to the gas pipe of the reference pressure supply part-unit in the space between the pressure regulation fitting and the regulation section of the transport pipe.

In another embodiment of the invention, an active shut-off fitting, for example, a motor-driven shut-off valve, is installed in the section of the transport pipe between the storage body and the separation fitting belonging to the extinguishing-launching part-unit. An emptying fitting is installed in the section of the transport pipe between the active shut-off fitting and the separation fitting belonging to the extinguishing-launching part-unit.

In an embodiment of the installed fire extinguishing equipment, the transport pipe is connected to the lower part of the pressure-resistant storage body.

The fire extinguishing equipment according to the invention has numerous advantageous characteristics. The most important of these is that, due to the extinguishing-launching part-unit that is completely different to the prior art, in the case of a fire, there are no active, moving parts operated by auxiliary energy in the structural parts serving for discharging the extinguishing material. Therefore, the probability of these shut-off fittings, relating to the shutting off of the extinguishing material discharge path, becoming faulty is essentially zero. As a consequence of this, the operation reliability of the novel extinguishing-launching part-unit is much greater than that of the traditional solutions.

Another advantage is that the rupture discs may also be installed in the place of the valves of the extinguishing-launching part-units used in the prior art without any special difficulty. Therefore, the novel solution may not only be fitted into newly installed fire extinguishing equipment, but also to those already in operation, therefore their operation reliability may be significantly increased and their operation costs reduced.

It must also be assessed as an advantage that the dimensioning and manufacture of the fittings fitted with rupture discs may be simply and cheaply produced. Therefore, the investment costs of the extinguishing-launching part-unit are more favorable than in the case of the valves usually used in the case of the known solutions.

Another feature that may be listed among the advantages is that, while the operability of the extinguishing-launching part-units of traditional installed fire extinguishing equipment must be periodically checked, which involves a significant investment in labor and losses of extinguishing material, in the case of the structure according to the invention, there is no need to perform tests of this nature on the extinguishing-launching part-unit. This difference in itself results in a great saving of operation costs.

It is also important to highlight that, as there is no need to use any kind of external energy source to "switch on" the rupture discs in the extinguishing-launching part-unit operated with rupture discs, in the case of an operation malfunction occurring in the pneumatic network, or a power outage, the extinguishing-launching part-unit continues to be reliably operable, which in the case of the traditional versions is not possible or only at significant extra cost.

In addition to the listed advantages, it must also be mentioned that, in the case of completing extinguishing, it is possible in the extinguishing-launching part-unit operated with rupture discs to save the extinguishing material remaining in the system by closing the active shut-off fitting. As this fitting does not participate in the launching of the extinguishing, only in its completion, it does not limit the operation reliability of the extinguishing process.

BRIEF DESCRIPTION OF THE DRAWINGS

For a fuller understanding of the invention, reference should be made to the following detailed description, taken in connection with the accompanying drawing, in which:

The FIGURE depicts a schematic picture of a possible version of the installed fore extinguishing equipment according to the invention provided with a novel extinguishing-launching part-unit.

DETAILED DESCRIPTION OF INVENTION

The FIGURE shows installed fire extinguishing equipment, including the storage body suitable for storing extinguishing material 6. The storage body 2 is a tank established as a usual pressure vessel. The fire extinguishing material 6 is located in the internal space 2*a* of the storage body 2. Naturally, the storage body 2 may also have a different form to that presented here. However, it is important to highlight that the internal space 2*a* of the storage body 2 must be pressurized, which pressure, during operation, forces the fire extinguishing materials 6 from the internal space 2*a* of the storage body 2 into the transport pipe 3. The fire extinguishing material 6 may get to the external end 3*a* of the transport pipe 3 located at the use location 1 via this transport pipe 3, which external end 3*a* is connected to an extinguishing part-unit 4 known in itself. If the fire extinguishing material 6 is extinguishing foam, then it is preferable if the transport pipe 3 is connected to the storage body 2 at the lower part 2*b* of the storage body 2, as a gas cushion occupies the upper part of the internal space 2*a* of the storage body 2, therefore the extinguishing foam may be introduced into the transport pipe 3 from the lower part 2*b* of the internal space 2*a* of the storage body. It must also be mentioned here that the storage body 2 may be supplied with numerous structural elements ensuring appropriate operation and monitoring of the equipment, which, however, are not of interest from the point of view of the operation of the present invention, so these are not marked or depicted for the sake of simplicity.

The active shut-off fitting 20 is located on the part of the transport pipe 3 close to the storage body 2, which in its basic state is open, and its task in the case of maintenance, for example, is to isolate the storage body 2 from the other part of the extinguishing-launching part-unit 10 installed in the transport pipe 3. Here the active shut-off fitting 20 is a motor-driven shut-off valve, but naturally may also be another appropriate shut-off structure.

The separation fitting 11 and transport regulation fitting 12 of the extinguishing-launching part-unit 10 are installed in the transport pipe 3 in the appropriate way, which are separated from each other by a space "T". The regulation section 3*b* is created between the separation fitting 11 and the transport regulation fitting 12, which essentially forms a delimited part of the transport pipe 3.

The gas pipe 13*a* of the reference pressure supply part-unit 13 forming a part of the extinguishing-launching part-unit 10 is connected to this regulation section 3*b* of the transport pipe 3. In addition to the gas pipe 13*a*, the reference pressure supply part-unit 13 also comprises a compressor 13*b*, pressure regulation fitting 13*c*, and shut-off fitting 13*d* also connected to the gas pipe 13*a*. The task of the compressor 13*b* is to supply a medium in the gas pipe 13*a* at the pressure required for the appropriate operation of the extinguishing-launching part-unit 10, which may be, for example, compressed air or another gas or liquid with the desired physical and/or even chemical characteristics, while the pressure regulation fitting 13*c* is responsible for setting and maintaining the desired pressure value. The shut-off fitting 13*d* serves for providing the partial pressure, or terminating the pressure, in the gas pipe 13*a* connected to the regulation section 3*b* of the transport pipe 3.

The section of the gas pipe 13*a* of the reference pressure supply part-unit 13 between the pressure regulation fitting 13*c* and the shut-off fitting 13*d* is connected to the event-detecting part-unit 5 located at the use location 1 via the supply pipe 5*d*. In the case of the given embodiment, the event-detecting part-unit 5 forms a closed ring returning to itself with a detecting space 5*b* surrounded by a membrane 5*a*. The charge 5*c* is located in the detecting space 5*b* of the membrane 5*a*, which is preferably, in the case of this embodiment, a gaseous medium, also located in the gas pipe 13*a*, at the pressure produced by the compressor 13*b* and adjusted by the pressure regulation fitting 13*c*. As a consequence of the above here the event-detecting part-unit 5 is established as a pneumatic detector.

The FIGURE also shows that the emptying fitting 30 is installed in the section of the transport pipe 3 between the active shut-off fitting 20 and the separation fitting 11. From the point of view of the structural arrangement of the present invention, these valves do not have any significance; their task is to isolate the storage body 2, and so the fire extinguishing material 6 stock, from the extinguishing-launching part-unit 10 and with this from the use location 1 itself, and, optionally, to isolate the inspection by sampling of the composition of the fire extinguishing material 6 in the transport pipe 3.

It must also be mentioned here that the storage body 2 may be connected to several transport pipes 3, each of which preferably runs to an individual use location 1, but here, also for the sake of simplicity, a single use location 1 and, accordingly, one transport pipe 3, is depicted.

It may also be observed in the FIGURE that, in the case of the given embodiment, the event-detecting part-unit 5 and the reference pressure supply part-unit 13 are in connection with the control center 7, in a way known in itself, gathering information and, optionally, intervention signal transmission. The task of the control center 7 is the monitoring of the entire network of the installed fire extinguishing equipment, the receiving and processing of the desired signals, and the operation of the individual intervention bodies depending on the result of the processing. As such, usual control centers 7 are known of in themselves, and the present specification does not discuss their structure and operation in more detail.

Important elements of the installed fire extinguishing equipment include the separation fitting 11 and transport regulation fitting 12 of the extinguishing-launching part-unit 10. The separation fitting 11 is installed in the part of the transport pipe 3 closer to the storage body 2, while the transport regulation fitting 12 is installed in the part of the transport pipe 3 closer to its external end 3*a*.

Diverging from the usual, however, the separation fitting 11 comprises the clamping housing 11*a*, as well as the separation rupture disc 11*b* installed in the clamping housing 11*a*, while the transport regulation fitting 12 contains the clamping housing 12*a* and the transport regulation rupture disc 12*b* appropriately secured in it. Both the separation rupture disc 11*b* and the transport regulation rupture disc 12*b* include dimensions such that the bursting of the rupture disc takes place in the case of a given pressure difference deriving from the pressures occurring on both sides of the rupture disc itself.

The compressor 13*b* fills the regulation section 3*b* established between the separation fitting 11 and the transport regulation fitting 12, and the desired pressure value is ensured by the pressure regulation fitting 13*c*. Naturally, there are control elements suitable for maintaining the regulation section in the appropriate pressure range, which are not indicated in the FIGURE.

During the operation of the installed fire extinguishing equipment, according to the FIGURE, the pressure in the storage body 2 filled with fire extinguishing material 6, and so under pressure, is exerted through the transport pipe 3 onto the side of the separation rupture disc 11*b* installed in the clamping housing 11*a* of the separation fitting 11 of the extinguishing-launching part-unit 10 towards the storage body 2. Opposite to this, with the extinguishing-launching part-unit 10 in its basic state, the pressure of the charge 5*c* supplied by the compressor 13*b* of the reference pressure supply part-unit 13 and regulated by the pressure regulation fitting 13*c* appears, on the one part, in the regulation section 3*b* of the transport pipe 3, and, on the other part, this pressure is present in the supply pipe 5*d* of the event-detecting part-unit 5 and, consequentially, also in the detecting space 5*b* of the of the event-detecting part-unit 5 encompassed by its membrane 5*a*.

Due to the pressure conditions presented previously, the separation rupture disc 11*b* of the separation fitting 11 must withstand the pressure difference in the regulation section 3*b* and on the side of the transport pipe 3 towards the storage body within a given tolerance range. In addition, the transport regulation rupture disc 12*b* of the transport regulation fitting 12 must withstand the difference in pressure in the regulation section 3*b* and the environmental pressure, also within a given tolerance range. Also, the bursting pressures of the separation rupture disc 11*b* and the transport regulation rupture disc 12*b* must be dimensioned in harmony with each other in the interest of appropriate operation. It is important to note that, in the case of the given embodiment of the installed fire extinguishing equipment, in the interest of the expected operation, the membrane 5*a* of the event-detecting part-unit 5 is made of a material that is destroyed on the effect of heat, such as plastic.

The pressure value in the regulation section 3*b* appears, on the one part, on the side of the separation rupture disc 11*b* of the separation fitting 11 towards the transport regulation fitting 12, and, on the other part, on the side of the transport regulation rupture disc 12*b* secured in the clamping housing 12*a* of the transport regulation fitting 12 facing towards the separation fitting 11. In addition, there is environmental pressure on the side of the transport regulation rupture disc 12*b* of the transport regulation fitting 12 facing towards the use location 1. In the interest of appropriate operation, in the case of this embodiment, the pressure set in the regulation section 3*b* of the transport pipe 3, and in the detecting space 5*b* of the event-detecting part-unit 5 due to the supply pipe 5*d* using the reference pressure supply part-unit 13, is half of the value of the pressure in the internal space 2*a* of the storage body 2.

When a fire starts at a given use location 1, then the membrane 5*a* of the event-detecting part-unit 5 bursts due to the heat of the fire, then the pressure in the detecting space 5*b* of the event-detecting part-unit 5 drops to environmental pressure. This drop in pressure results in the pressure also dropping in the regulation section 3*b* of the transport pipe 3. As a result of the drop in pressure in the regulation section 3*b*, the separation rupture disc 11*b* of the separation fitting 11 bursts due to the effect of the unchanged pressure coming from the internal space 2*a*, and so the pressure of the fire extinguishing material 6 flowing through the clamping housing 11*a* of the separation fitting 11 now appears on the side of the transport regulation rupture disc 12*b* of the transport regulation fitting 12 facing the separation fitting 11. Following this, the increased pressure in the regulation section 3*b* also bursts the transport regulation rupture disc 12*b* of the transport regulation fitting 12, and the fire extinguishing material 6 can now flow through the clamping housing 12*a* of the transport regulation fitting 12 in the direction of the external end 3*a* of the transport pipe 3 towards the extinguishing part-unit 4. Finally, reaching the extinguishing part-unit 4 via the external end 3*a* of the transport pipe 3, the fire extinguishing material 6 is able to exert its fire-extinguishing effect at the use location 1.

It must be mentioned here that the membrane 5*a* of the event-detecting part-unit 5 may also be made of a more rigid, fire-resistant material. In this case, however, a charge 5*c* must be placed in the detecting space 5*b* surrounded by the membrane 5*a* that expands or evaporates on the effect of heat when a fire occurs, and in this way causes an increase in pressure in the supply pipe 5*d*, in the gas pipe 13*a* of the reference pressure supply part-unit 13, and in the regulation section 3*b* of the transport pipe 3. In the case of a given embodiment, the bursting pressure of the separation rupture disc 11*b* of the separation fitting 11 must be lower than the bursting pressure of the transport regulation rupture disc of the transport regulation fitting 12; furthermore, with the extinguishing-launching part-unit 10 in its basic state, the value of the pressure in the regulation section of the transport pipe 3 must be greater than the pressure in the internal space 2*a* of the storage body 2.

In the case of appropriately adjusted pressures and well dimensioned separation rupture disc 11*b* and transport regulation rupture disc 12*b*, the rupture disc 12*b* of the transport regulation fitting 12 and the separation rupture disc 11*b* of the separation fitting 11 burst here also and the fire extinguishing material 6 flows, as presented previously, out at the external end 3*a* of the transport pipe 3 into the extinguishing part-unit 4, and so extinguishing may start.

When extinguishing is completed, the burst separation rupture disc 11*b* and the transport regulation rupture disc 12*b* must be replaced with new rupture discs with the appropriate bursting pressure.

The invention may be used to good effect in all locations where there is a need for installed fire extinguishing equipment that can be installed and operated at a favorable cost, and that has reliable extinguishing launching.

What is claimed is:

1. A fire extinguishing equipment comprising:

a pressure-resistant storage body including an internal space configured to house a fire extinguishing material therein;

at least one transport pipe in communication with the internal space of the storage body, the at least one transport pipe configured to transport the fire extinguishing material from the internal space of the storage body to a use location, the at least one transport pipe including an external end opposite the internal space of the storage body, with a separation fitting disposed at within the at least one transport pipe;

an extinguishing part-unit connected to the at least one transport pipe at the external end thereof, the extinguishing part-unit coupled to one or more event-detecting part-units, wherein at least a portion of the one or more event-detecting part units are connected to an extinguishing-launching part-unit having the separation fitting and a transport regulation fitting that is installed within the at least one transport pipe, the transport regulation fitting separated from the separation fitting by a space, wherein:

the transport regulation fitting includes a clamping housing with a transport regulation rupture disc fixed in the clamping housing, and the separation fitting includes a clamping housing and a separation rupture disc fixed in the clamping housing; and a reference pressure supply part-unit disposed within the at least one transport pipe within the space separating the transport regulation fitting and the separation fitting, the reference pressure supply part-unit configured to set a desired pressure value for the fire extinguishing material upon release, wherein the transport regulation rupture disc and the separation rupture disc are configured to rupture upon a detection of a fire to release the fire extinguishing material from the pressure-resistant storage body.

2. The fire extinguishing equipment of claim 1, wherein the one or more event-detecting part-units is a pneumatic detector including a pressure-retaining membrane that encompasses a detecting space, wherein the membrane bursts on the effect of heat.

3. The fire extinguishing equipment of claim 1, wherein the one or more event-detecting part-units is a pneumatic detector including a pressure-retaining membrane filled with a charge that expands or evaporates on the effect of heat.

4. The fire extinguishing equipment of claim 1, wherein in a default configuration of the extinguishing-launching part-unit, a pressure value of the at least one transport pipe is less than a pressure value of the internal space of the storage body.

5. The fire extinguishing equipment of claim 1, wherein in a default configuration of the extinguishing-launching part-unit, a bursting pressure of the separation rupture disc of the separation fitting is lower than a bursting pressure of the transport regulation rupture disc of the transport regulation fitting, and a pressure value of the at least one transport pipe is greater than a pressure value of the internal space of the storage body.

6. The fire extinguishing equipment of claim 1, wherein the reference pressure supply part-unit further comprises:

a gas pipe connected to the at least one transport pipe;

a compressor connected to an end of the gas pipe opposite the at least one transport pipe; and a pressure regulation fitting disposed within the gas pipe.

7. The fire extinguishing equipment of claim 6, wherein the event-detecting part-unit includes a supply pipe that is connected to the gas pipe of the reference pressure supply part-unit in space between the pressure regulation fitting and the at least one transport pipe.

8. The fire extinguishing equipment of claim 1, further comprising an active shut-off fitting disposed within a portion of the at least one transport pipe between the storage body and the separation fitting of the extinguishing-launching part-unit.

9. The fire extinguishing equipment of claim 8, further comprising an emptying fitting disposed within a portion of the at least one transport pipe between the active shut-off fitting and the separation fitting of the extinguishing-launching part-unit.

10. The fire extinguishing equipment of claim 1, wherein the at least one transport pipe is secured to a lower part of the storage body.

* * * * *